United States Patent [19]

Anhalt et al.

[11] 4,073,560

[45] Feb. 14, 1978

[54] ELECTRICAL CONNECTOR

[75] Inventors: John W. Anhalt, Orange; David S. Goodman, Mission Viejo; Carl W. Peterson, Westminster, all of Calif.

[73] Assignee: International Telephone and Telegraph Corporation, New York, N.Y.

[21] Appl. No.: 664,488

[22] Filed: Mar. 8, 1976

[51] Int. Cl.[2] ..... H01R 13/38

[52] U.S. Cl. ..... 339/99 R

[58] Field of Search ..... 339/97–99

[56] References Cited

U.S. PATENT DOCUMENTS

| | | | |
|---|---|---|---|
| 3,355,699 | 11/1967 | Oshva | 339/99 R |
| 3,768,067 | 10/1973 | Rault | 339/99 R |
| 3,955,873 | 5/1976 | Peterson | 339/99 R |
| 3,964,816 | 6/1976 | Narozny | 339/99 R |

*Primary Examiner*—Joseph H. McGlynn
*Attorney, Agent, or Firm*—Thomas L. Peterson

[57] ABSTRACT

An electrical connector for a flat cable having alternate signal and ground conductors. The connector comprises a housing containing a row of contacts therein each having an insulation piercing, core penetrating section. A mandrel is mounted on the housing forcing the signal conductors of the cable into the termination sections of the contacts. The ground conductors of the cable lie across the top of the housing and a ground buss bar having a plurality of insulation piercing, core penetrating jaws is forced down upon the ground conductors to electrically interconnect the same. The ends of the ground buss bar engage the contacts at the ends of the row of contacts in the connector housing.

12 Claims, 9 Drawing Figures

ELECTRICAL CONNECTOR

BACKGROUND OF THE INVENTION

The present invention relates generally to an electrical connector and, more particularly, to an electrical connector for making connections to ground and signal conductors of a cable and for bussing the ground conductors.

It is sometimes necessary in certain circuit designs to use flat cables incorporating alternate ground and signal conductors so that the ground conductors will electrically shield the signal conductors. To electrically terminate such a cable, it is presently the practice to terminate the cable to an electrical connector in a manner so that all the signal conductors are fed through the connector, and the ground conductors are bussed and fed through the connector in four positions. The flat cable conductors are soldered to a printed circuit board and then another solder joint is made between the printed board and the connector contacts. This technique is both expensive and bulky. It is the purpose of the present invention to overcome the aforementioned disadvantages by utilizing a connector which is relatively inexpensive to manufacture, is simple to assemble, and is relative compact.

SUMMARY OF THE INVENTION

According to the principal aspect of the present invention, there is provided an electrical connector for an electrical cable having signal and ground conductors comprising a housing having a row of contacts therein, each provided with a conductor termination section. The termination section embodies insulation piercing, core penetrating jaws. An insulative mandrel mounted on the housing serves to forcibly insert the signal conductors of the cable into the jaws formed by the termination sections of the contacts, thereby electrically connecting the signal conductors to the contacts. A ground buss is provided which is formed with a plurality of spaced insulation piercing, core penetrating jaws. The ground conductors of the cable are laid across the top of the mandrel and the buss bar is forced down over the conductors so that the jaws thereon electrically engage the individual ground conductors, thereby bussing all the ground conductors. Thus, insulation piercing jaws are utilized to make electrical connections to the signal and ground conductors of the cable in a simple and inexpensive manner, thereby eliminating the need for the soldering operations as in previous systems of this general type. Other aspects and advantages of the present invention will become more apparent from the following description taken in connection with the accompanying drawings.

DESCRIPTION OF THE PREFERRED EMBODIMENTS

Figure 7:
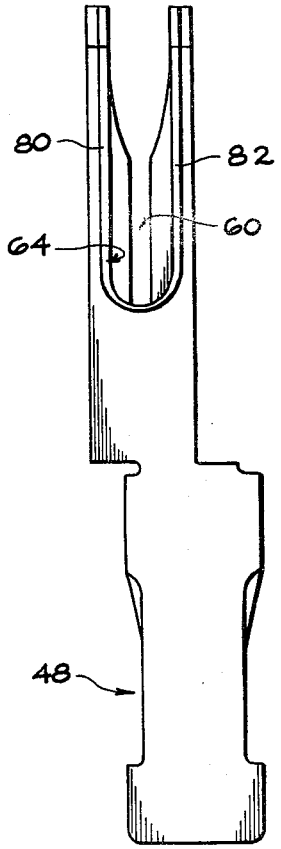
FIG. 7 is a rear view of the contact illustrated in FIG. 5.
Figure 8:
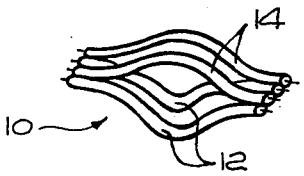
FIG. 8 is a fragmentary prospective view of a flat cable which may be terminated by the connector of the present invention to the printed circuit board illustrated in FIG. 1, with portions of the signal and ground conductors of the cable separated into two groups for termination to the connector.

Referring first to FIG. 7 in detail, there is illustrated a round wire flat cable, generally designated 10, in which alternate conductors are ground and signal conductors when utilized in the electrical system in which the cable is utilized. The insulation of the cable is sliced longitudinally between the conductors a short distance between the ends of the cable so that there are provided individual, spaced, signal conductors 12 and ground conductors 14, each of which includes a central metallic core covered with insulation. To terminate the flat cable 10 to the connector of the present invention, the signal conductors 12 and ground conductors 14 are divided into two separate groups, with the ground conductors disposed above and spaced from the signal conductor 12, as seen in FIG. 8.

Referring now to FIGS. 1–4 of the drawings in detail, the connector of the present invention, generally designated 20, comprises an elongated insulative housing 22, an elongated insulative mandrel 24, and an insulative strain relief cap 26 in which there is mounted a ground buss bar 28. The buss bar is shown separated from the cap in FIG. 1 for purposes of clarity. The connector may be connected to a printed circuit board 30 containing two parallel rows of spaced, wire wrap posts 32 which are mounted in holes 34 in the board. The holes may be plated-through holes and the wire wrap posts may be press fit into the holes in the manner well known in the art. While wire wrap posts are shown as being mounted in the board 30, it will be appreciated that any form of pin contact may be mounted on the board for mating with the contacts in the connector 20.

The elongated housing 22 of the connector contains preferably two rows of spaced contact cavities 36 and 38. The cavities extend vertically from the mating of lower side 40 of the housing to the upper conductor receiving side 42 thereof. Contacts 44 are mounted in each of the cavities 36 and 38. The contacts in the two rows of cavities may be identical. While two rows of contacts are illustrated in the drawing, it will be appreciated that the connector housing 22 may contain only a single row of contacts, if desired.

Figure 5:
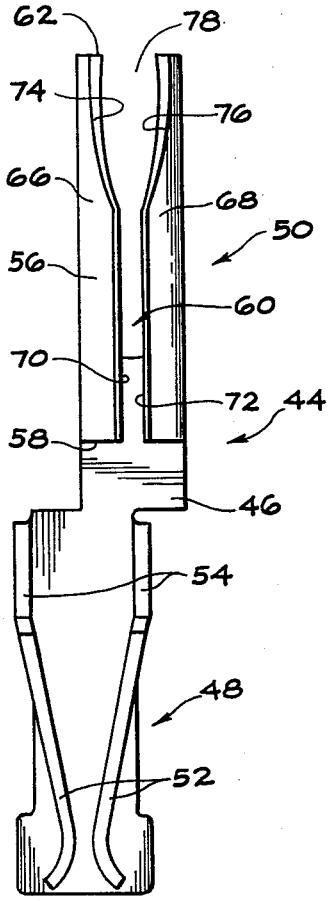
FIG. 5 is a front view of a contact utilized in the connector illustrated in FIGS. 1–3.
Figure 6:
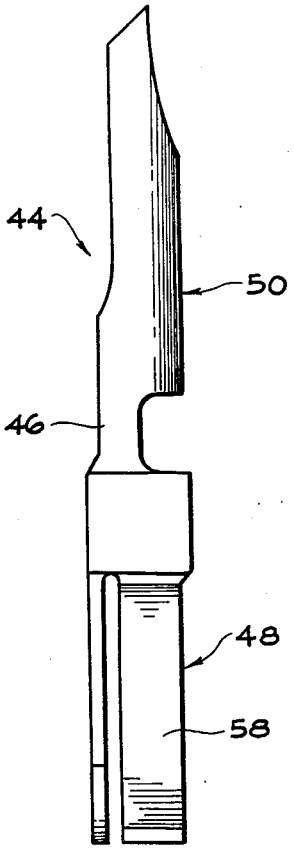
FIG. 6 is a side view of the contact illustrated in FIG. 5.

As best seen in FIGS. 5–7, each contact 44 has a generally flat base portion 46 with a lower contacting portion 48 thereon and an upper termination section 50. The contacting portion is preferably laterally offset from the termination section as seen in FIGS. 5–7. The contacting portion includes a pair of bowed spring contact members 52 each integrally connected to the base portion 46 by an upwardly bent flange 54.

The upper termination section 50 of the contact comprises a generally tubular section 56 having its lowered end 58 adjacent to and integrally joined to the base portion 46. A slot 60 extends longitudinally through the tubular section 56 from the lower end 58 to the upper end 62 thereof. This slot is on the side of the tubular section opposite to the base portion 46. A second slot 64 is provided in the tubular section 56 on the side thereof opposite to the first slot 60. The second slot 64 extends from the upper end 62 of the tubular section downwardly, but short of the lower end 58.

The first slot 60 which extends the entire length of the tubular section 56 divides that section into a pair of resilient, arcuate side wall 66 and 68 having longitudinally extending spaced edges 70 and 72, respectively, defined by the slot. The resilient side walls provide a spring action which causes the edges 70 and 72 to make electrical connection to a signal conductor 12 in a manner which will be described in detail later. The second shorter slot 64 also results in a spring action being produced on the opposite side of the termination section 50 for strain relief of the conductor.

The lower portions of the edges 70 and 72 adjacent to the lower end 58 of the termination section of the contact are uniformly spaced from each other while the upper portions of the edges diverge outwardly at 74 and 76 to the upper end 62 providing a conductor entrance area 78.

The edges 70 and 72 of the arcuate side walls 66 and 68 of the termination section of the contact extend radially while the rear outwardly diverging edges 74 and 76 have a tapered arcuate configuration. The tapered arcuate edges 74 and 76 commence from the radially extending edges 70 and 72 and taper rearwardly into a generally flat plane parallel to the plane of the relatively flat base portion 46 of the contact. Thus, the edges 70, 72, 74, and 76 provide cutting edges or jaws for a conductor.

A slot 40 on the opposite side of the tubular section 56 of the contact provides a pair of uniformly spaced edges 80 and 82, which are spaced apart a distance greater than the edges 70 and 72. The edges 80 and 82 extend radially to also provide cutting edges or jaws.

The configuration of the termination section 50 of the contact is designed so as to permit a conductor, such as the signal conductor 12, to be inserted into the termination section at an acute angle with respect to the axis of the tubular section of the contact. The distance between the jaws 70 and 72 of the contact is less than the diameter of the core of the signal conductor 12 so that when the conductor is pushed through the entrance way 78 down between the jaws 70 and 72, the jaws will pierce the insulation on the conductor and penetrate the core thereof, thereby electrically and mechanically connecting the conductor to the contact. The distance between the jaws 80 and 82 on the contact is greater than the diameter of the core of the conductor, but less than the diameter of the insulation thereon so that when the conductor is pushed between the jaws 80 and 82, the jaws will penetrate the conductor, but not the core thereof, thereby providing strain relief for the conductor. The arcuate side walls 66 and 68 of the tubular section of the contact possess an inherent spring action which assures that good mechanical and electrical interconnection between the conductor and the contact is made.

While the contact 44 described hereinabove and illustrated in the drawings is the preferred form for use in the present invention, the invention is not limited to the use of this specific contact. For example, the lower contacting portions 48 of the contact may be in the form of a generally cylindrical, longitudinally slotted socket which may mate with a wire wrap post 32. Further, the upper termination section of the contact may employ different forms of insulation piercing, core penetrating jaws than that described herein. For example, the termination section of the contact could be a flat metal plate with a V groove or notch formed therein terminating in a slot extending vertically downwardly from the apex of the notch. Such an arrangement would provide electrical connection to the core of a conductor, but no strain relief as does the contact 44.

Figure 3:
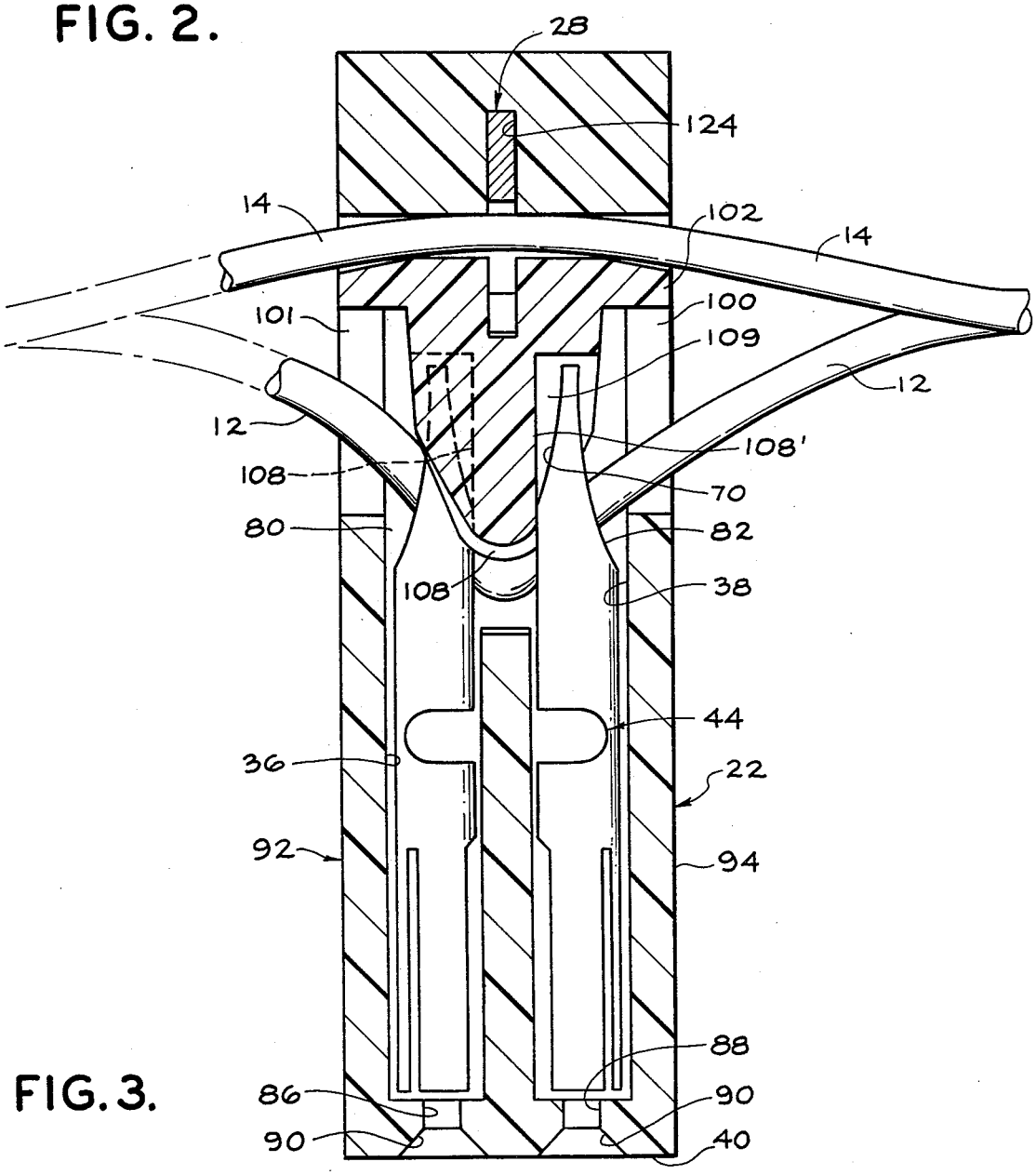
FIG. 3 is an enlarged, vertical sectional view taken along line 3—3 of FIG. 2 showing signal and ground leads of a flat cable terminated to the connector.

The contacts are mounted in the two rows of cavities 36 and 38 in the connector housing so that the insulation piercing, conductor penetrating jaws 70 and 72 face each other while the strain relief jaws 80 and 82 face outwardly, as seen in FIG. 3. The contacts may be secured in the cavities 36 and 38 in in any suitable manner, not shown. The lower ends of the contact cavities in the two rows are aligned, but the upper ends are staggered to receive the offset termination ends of the contacts. This arrangement permits the termination ends of the contacts to be longitudinally spaced in the connector housing which facilitates insertion of the signal conductors in the contacts.

The lower end 40 of the housing 22 contains two rows of holes 86 and 88 aligned with the lower ends of cavities 36 and 38, respectively. The cross-section of the holes is less than that of the cavities so as to provide a closed entry into the cavities. The holes are chamfered as indicated at 90 to provide an entrance way or guide for the wire wrap posts 32 into the cavities for engagement with the socket portions of the contacts 44 when the connector housing is mounted over the posts onto the printed circuit board 30.

The housing 22 includes vertically extending parallel side walls 92 and 94 and end walls 96 and 98. Vertical guide slots 100 and 101 are formed in the upper ends of the side walls 92 and 94, respectively. The lower ends of the slots are disposed below the upper ends of the contacts. The slots are aligned with the upper ends of the contact cavities 36 and 38, respectively, so that the slots will be staggered and, hence, in alignment with the jaws 70, 72, and 80, 82 of the staggered termination sections of the contacts. The slots 100 are sufficiently wide to receive the signal conductors 12 thereinto so that the signal conductors 12 of the flat cable 10 may be individually laid alternatively in the slots 100, 101 and positioned within the entrance ways 78 of the two rows of contacts.

Figure 4:
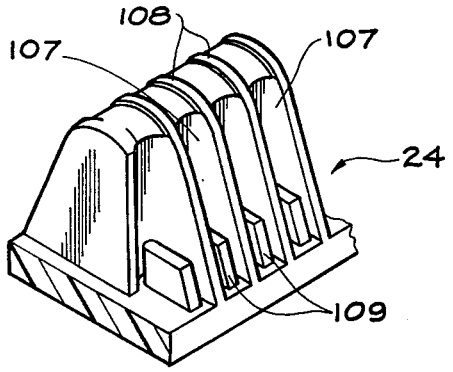
FIG. 4 is a fragmentary perspective view of the mandrel employed in the connector of FIGS. 1–3, the mandrel being shown in an inverted position.
Figure 4A:
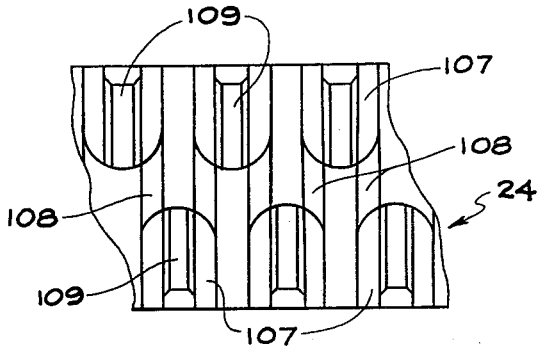
FIG. 4*a* is a fragmentary bottom view of the mandrel.

The mandrel 24 includes an upper flat portion 102 and a lower tapered portion 104 defining downwardly and inwardly diverging sides 106. The opposing sides 106 of the mandrel are formed with vertically extending, spaced staggered recesses 107, as best seen in FIGS. 4 and **4*a*. The spacing of the recesses on the opposite sides of the mandrel corresponds to the spacing of the guide slots 100, 101, respectively, on the opposite sides of the housing 22 and the spacing of the upper termination sections of the contacts 44 in the housing. The recesses receive the termination sections of the contacts when the mandrel is mounted on the connector housing. The bottom of the mandrel has spaced ribs 108 which help to properly locate the conductor 12. Vertical projections 109 are formed in the recesses 107** so that a projection extends down into the termination section of each contact when the mandrel is mounted on the housing, as best seen in FIG. 3. The projections serve to push the conductors 12 into the jaws of the contacts.

Figure 1:
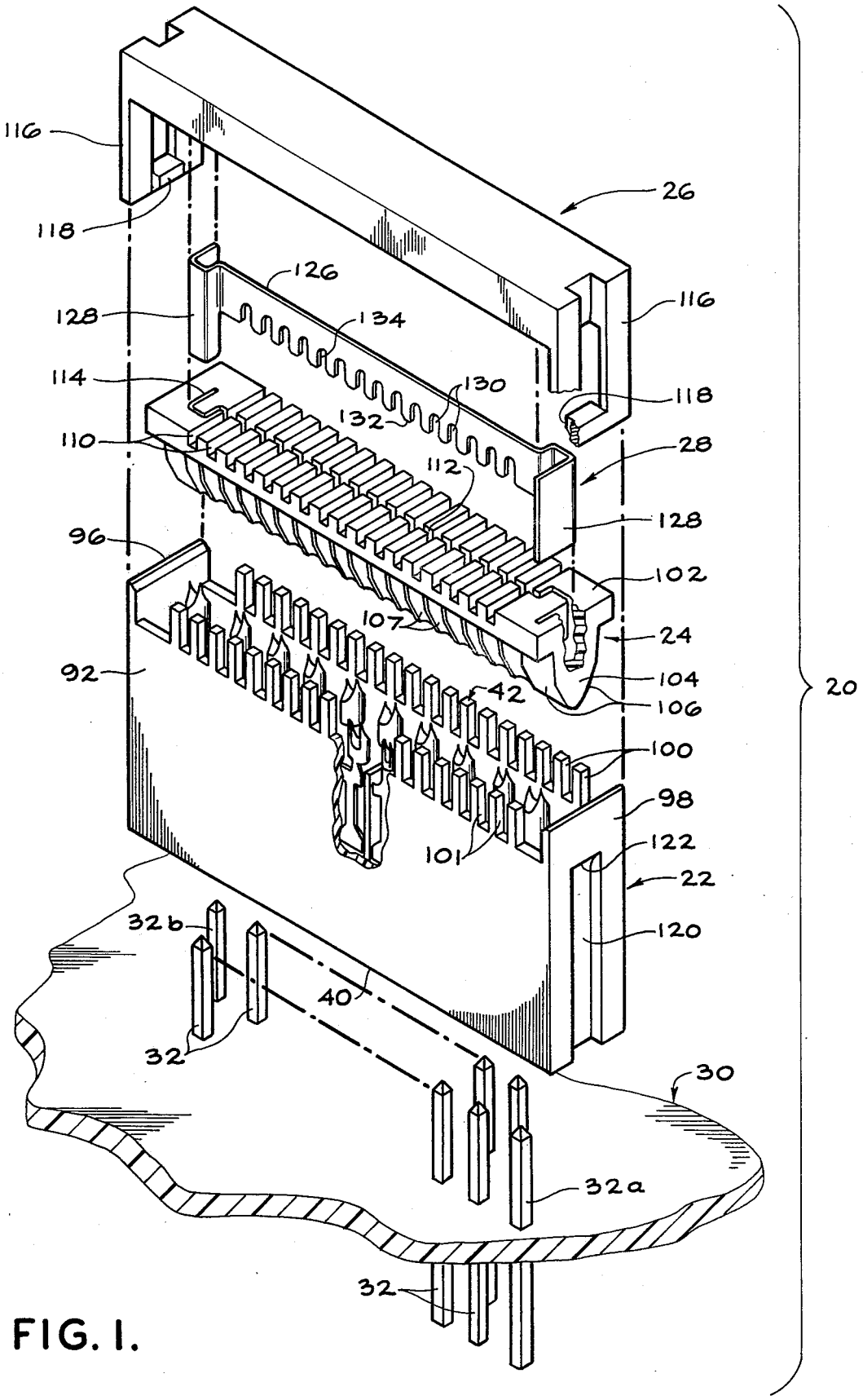
FIG. 1 is an exploded perspective view of the connector of the present invention, positioned over a printed circuit board containing wire wrap posts which are engaged by contacts in the connector.

Spaced laterally extending parallel slots are aligned with the recesses 107 and the guide slots 100, 101 although it is not necessary for the slots 110 to be so aligned. The slots 101 are dimensioned to receive the ground conductors 14 of the flat cable 10 therein. A longitudinally extending slot 112 is formed in the upper flat portion 102 of the mandrel. The ends 114 of the slot 112 have a generally U-shaped configuration, as seen in FIG. 1. The length of the mandrel 24 is selected so that the mandrel may be inserted into the connector housing between the upper ends of end walls 96 and 98. The lower tapered portion 104 of the mandrel is sufficiently narrow that such portion may be inserted between the upper portions of the two rows of contacts 36 and 38, as seen in FIG. 3, when the upper flat portion 102 of the mandrel rests upon the upper ends of the side walls 92 and 94 of the housing 22.

Figure 2:
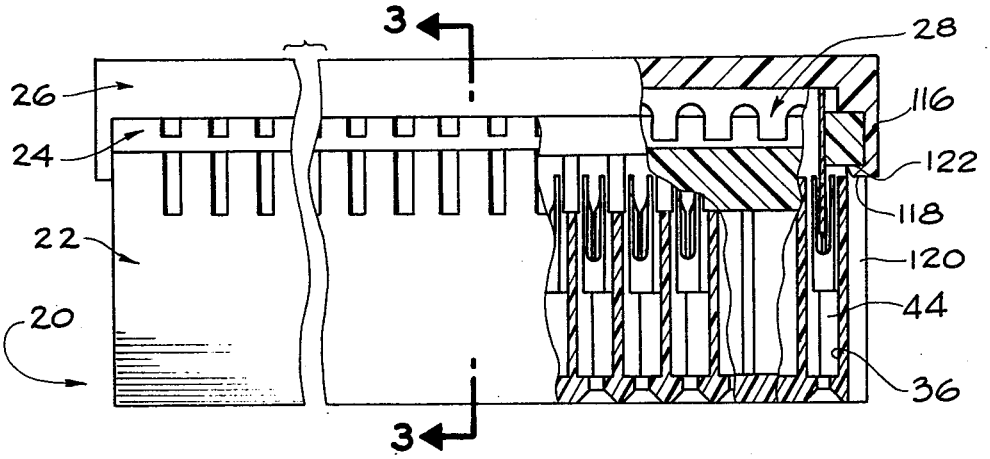
FIG. 2 is a framentary side elevational view of the connector illustrated in FIG. 1 in its fully assembled condition, with portions of the wall of the connector broken away to show the details of structure of the interior of the connector.

The cap 26 is formed with a pair of resilient downwardly extending legs 116 at its opposite ends each formed with an inwardly directed latch element 118. The latch elements 118 are aligned with vertical recesses 120 formed in the end walls 96, 98 of the housing 22. The latch elements engage the upper ends 122 of the recesses to retain the cap, and hence the mandrel 24, on the housing 22, as seen in FIG. 2. The ground buss bar 28 is fixedly mounted in a vertical slot 124 formed on the underside of the cap 26, as seen in FIG. 3. The buss bar is formed of a relatively rigid sheet metal strip formed into the desired configuration. More specifically, the buss bar includes an elongated, vertically extending flat central section 126 and a pair of downwardly extending leg sections 128 at the opposite ends of the central section. The U-shaped slots 114 in the mandrel 24. The length of the buss bar is such that it may be inserted into the slots 112 and 114 in the mandrel when the cap 126 is mounted onto the connector housing 22 with the mandrel in position on top of the housing.

The central section 126 of the buss bar is formed with longitudinally spaced notches 130 which open at the lower edge 132 of the buss bar. The spacing of the notches 130 corresponds to the spacing of the laterally extending slots 110 in the upper portion of the mandrel. The edges 134 of each notch 130 are sharpened to provide cutting jaws. The jaws are spaced apart a distance slightly less than the diameter of the cores of the ground conductors 14 so that the jaws will pierce through the insulation of the conductors and penetrate the cores to mechanically and electrically interconnect all the ground conductors when the later are engaged by the buss bar.

In order to utilize the connector 20 of the present invention, the signal conductors 12 and ground conductors 14 of the flat cable 10 are separated into two groups as described hereinbefore and as illustrated in FIG. 8. The mandrel 24 is then positioned laterally between the two groups of conductors, aligning the signal conductors with the grooves 108 and the ground conductors with the slots 110 in the mandrel. The mandrel with the conductors assembled thereto is positioned on the upper end of the connector housing 22 so that the signal conductors will lie in corresponding guide slots 100, 101 and the entrance ways 78 of the termination sections of the contacts 44. The cap 26 is then mounted over the mandrel onto the housing 22 causing the buss bar 28 to be slidably inserted into the slots 112 and 114 in the mandrel. With the cap so positioned on the mandrel, the jaws 134 of each notch 130 of the mandrel will engage a corresponding ground conductor 14 positioned within a slot 110 in the upper portion of the mandrel. The connector assembly is then closed and locked using a parallel jaw tool, not shown, or the like causing the latch elements 118 on the cap to be positioned below the upper ends 122 of the recesses 120 in the housing 22. During the closing and locking of the connector, all the signal conductors 12 are terminated to their respective termination ends of the contacts 44 and all the ground conductors 14 are electrically interconnected by the ground buss bar 28.

The lower end of the leg 128 at the right-hand end of the buss bar, as viewed in FIGS. 1 and 2, is positioned so that it engages the contact 44 in the contact cavity 36 at the right-hand end of the housing 22. The opposite leg 128 of the buss bar is arranged so that it engages the contact 44 in the contact cavity 38 at the opposite end of the connector housing, not shown. Thus, the buss bar serves to electrically interconnect all the ground conductors 14 to each other and to the two contacts at the opposite ends of the connector housing.

When the connector 20 is mounted over the wire wrap posts 32 on the printed circuit board 30, the posts will be slidably received in the lower socket contacting sections of the contacts 44 in the connector. The posts 32*a* and 32*b* will engage the ground contacts at the opposite ends of the housing 22 which are electrically connected to the buss bar 28, thereby providing electrical connection at two points on the printed circuit board with the ground conductors 14 of the cable 10. Thus, the remaining wire wrap posts 32 in the board 30 provide signal contact termination points on the board for the signal conductors 12 of the cable.

While the invention has been described specifically herein in connection with the use of a flat cable, it will be appreciated that any form of cable may be utilized, as well as individual conductors in a system in which it is desired to provide individual contacts for selected conductors and a bussing arrangement for the remaining conductors. As will be appreciated, the connector of the present invention is relatively simple, inexpensive, easy to assemble, and may be made relatively small for use in high density packaging arrangements.

What is claimed is:

1. An electrical connector for an electrical cable having signal and ground conductors each having a metallic core covered with insulation comprising:

an elongated insulative housing;

said housing having a conductor receiving side and a mating side;

a row of spaced contact receiving cavities in said housing extending from said conductor receiving side to said mating side;

contacts mounted in said cavities, each said contact having a contacting section on said mating side and a termination section on said conductor receiving side;

said termination section of each said contact embodying insulation piercing, core penetrating jaws;

an insulative mandrel removably mounted on said conductor receiving side of said housing;

said mandrel having a first side facing said housing and a second side opposite to said first side, said first side embodying means for forcibly inserting portions of said signal conductors into said jaws to electrically connect said signal conductors to said contacts when said mandrel is mounted on said housing;

a ground buss bar mounted on said second side of said mandrel;

said buss bar embodying a plurality of spaced insulation piercing, core penetrating jaws; and means on said second side of said mandrel cooperating with said buss bar jaws for forcibly inserting portions of said ground conductors into said buss bar jaws to electrically connect said ground conductors to said buss bar when said buss bar is mounted on said mandrel.

2. An electrical connector as set forth in claim 1 wherein:

said buss bar engages a pair of said contacts.

3. An electrical connector as set forth in claim 1 wherein:

said buss bar embodies downwardly extending legs adjacent to its ends, said legs engaging the contacts in the cavities at the end of said rows of cavities.

4. An electrical connector as set forth in claim 1 including:

a second row of said contact receiving cavities in said housing parallel to and spaced from said first-mentioned row of cavities, said cavities in said second row each receiving one of said contacts thereby providing two rows of said contacts, said termination sections of said contacts in said two rows being staggered relative to each other; and said mandrel extends downwardly between said termination sections of said contacts in said two rows of contacts.

5. An electrical connector as set forth in claim 1 including:

guide means on said conductor receiving side of said housing for guiding said signal conductors of said cable into said termination sections of said contacts.

6. An electrical connector as set forth in claim 1 wherein:

said buss bar has a plurality of notches opening at one edge thereof, the sides of said notches providing said buss bar jaws.

7. An electrical connector as set forth in claim 1 including:

a cap overlying said mandrel, said cap embodying means removably retaining said mandrel on said housing; and said buss bar being carried by said cap.

8. An electrical connector as set forth in claim 1 wherein:

said contacting section of each said contact is a socket contact; and said mating side of said housing embodies means providing a closed-entry, bevelled entranceway into each said socket contact.

9. An electrical connector as set forth in claim 1 wherein:

said means on said second side of said mandrel comprises a plurality of laterally extending parallel slots for receiving said ground conductors, said slots being spaced apart a distance corresponding to the spacing of said buss bar jaws.

10. An electrical connector as set forth in claim 9 including:

a slot extending lengthwise of said mandrel in said second side thereof, said slot receiving said buss bar.

11. An electrical connector connected to an electrical cable having a plurality of signal conductors and a plurality of ground conductors comprising:

a connector housing containing signal contacts and a ground contact;

each of said signal contacts having insulation piercing-conductor penetrating jaws;

a mandrel mounted on said housing;

said signal conductors of said cable passing between one side of said mandrel and said housing and said ground conductors overlying the side of said mandrel opposite to said one side;

said mandrel embodying means on said one side forcibly inserting portions of said signal conductors into said jaws of said signal contacts;

a buss bar on said opposite side of said mandrel embodying insulation piercing-conductor penetrating jaws, said buss bar engaging said ground contact; and said buss bar cooperating with said mandrel to forcibly insert portions of said ground conductors into said buss bar jaws.

12. An electrical connector as set forth in claim 11 wherein:

said ground contact also has insulation piercing-conductor penetrating jaws; and said buss bar engages said ground contact jaws.

* * * * *